US006072135A

United States Patent [19]

O'Connor

[11] Patent Number: 6,072,135

[45] Date of Patent: Jun. 6, 2000

[54] SELF-ALIGNING BUTTON RETAINER

[75] Inventor: Kurt Francis O'Connor, Carmel, Ind.

[73] Assignee: Delphi Technologies, Inc., Troy, Mich.

[21] Appl. No.: 09/340,786

[22] Filed: Jun. 28, 1999

[51] Int. Cl.[7] ..... H01H 21/80

[52] U.S. Cl. ..... 200/345; 200/5 R; 200/339

[58] Field of Search ..... 200/5 R, 5 A, 200/6 R, 16 R, 553, 556, 517, 561, 558, 559, 329, 339, 341, 345, 11 R, 11 TN, 301, 302.1, 302.3

[56] References Cited

U.S. PATENT DOCUMENTS 4,218,602 8/1980 Creech ..... 200/302

4,476,360 10/1984 Theurer ..... 200/302.1

4,772,767 9/1988 Sawada ..... 200/302.3

*Primary Examiner*—Michael Friedhofer

*Attorney, Agent, or Firm*—Jimmy L. Funke

[57] ABSTRACT

A switch mechanism for an electronic mechanism, particularly in an automobile or other vehicle. The switch member or button has a pair of post members which are positioned on supporting members on a retainer member. The support members also position the switch member or button in the retainer member and hold it fictionally in alignment along its side surfaces. Pad members also can be provided on the support members. The switch mechanism minimizes noise, undesirable side-to-side movement and undesirable twisting movement of the button member. The switch mechanism also allows control of the "feel" of the button actuation.

15 Claims, 2 Drawing Sheets

SELF-ALIGNING BUTTON RETAINER

TECHNICAL FIELD

The present invention relates to switch mechanisms for electronic products, particularly button-type rocker switch mechanisms.

BACKGROUND OF THE INVENTION

There are numerous types of switch mechanisms in use today for operating and regulating systems and components of vehicles and other devices. The switch mechanisms can be on-off type switches, switch mechanisms which regulate the volume, amplitude and/or intensity of various systems, switch mechanisms which are available only for emergency-type usage, and the like.

In automobiles and other vehicles, there are numerous types of switch mechanisms which are used for the various electronic components and systems that are available and in use in the vehicles. These electronic components include windshield wipers, emergency lights, turn signals, cruise control, power seats, power windows, heated seats, four-wheel drive systems, overdrive systems, navigation systems, timing systems, clocks, mileage, trip or travel systems, and the like. Many of these switch mechanisms have dual functions, such as being used not only to control, for example, the on-off status of the component or system, but also to adjust one of its functions, such as amplitude, balance, base, treble, etc. Many of these switches utilize rocker-type buttons which pivot or rotate around a central point or section and have two ends which are adapted to operate or actuate certain switches or systems.

Switch mechanisms are typically designed to meet various criteria and considerations other than function. The considerations include appearance, aesthetics, positioning, ease of use, versatility of function, and design. These considerations can affect the size, color, type, and method of activation of the switch mechanism. The switch mechanisms are also made from various types of materials, including plastic, acrylic, and metal materials. In this regard, cost and durability factors can be significant in the final selection of the switch mechanisms to be utilized.

Although there are numerous switch mechanisms in use today which operate satisfactorily, there is a constant need to improve the operation, versatility and appearance of various switches, as well as to correct problems with existing switches. For example, some of the switch mechanisms provide excess freedom of movement, have undesirable noise problems, are too expensive, have alignment problems in the socket or housing in which they are positioned, do not operate with the requisite "feel," or are simply too difficult to operate for the desired function. Thus, a need exists for improved switch mechanisms, particularly those which minimize noise problems, have improved alignment, have the desired "feel" or can be adjusted to achieve a desired feel, and which can be easily and simply activated.

SUMMARY OF THE INVENTION

It is an object of the present invention to provide an improved switch mechanism. It is also an object of the present invention to provide an improved switch mechanism for an electronic system for an automobile or other vehicle.

It is a further object of the present invention to provide an improved switch mechanism which has a rocker-type switch member. It is still another object of the present invention to provide a self-aligning button-type switch mechanism which reduces the noise and activation problems with existing switches of the same type.

It is still another object of the present invention to provide the switch mechanism in which the movement of the switch member can be controlled more precisely.

The present invention provides an improved switch mechanism which overcomes the above-identified problems with the prior art and meets the objects and advantages set forth above. In this regard, the present invention provides a self-aligning rocker-type switch mechanism which utilizes support members in the retainer or housing. The switch mechanism has a rocker-type button member with a pair of centrally located pivot pin members retained in a fixture or housing and which allow the switch member to be rocked or rotated about them. As opposed to prior art rocker-type switches which used pointed ends on the pivot pins to position the button members in the retainers, the present invention utilizes support members in the retainer or housing which apply pressure to the sides of the switch member and better control its activation and movement. Separate support pads can also be utilized on the support members to adjust or change the "feel" of the actuation as well as to assist in the alignment and stability of the button.

The present invention can be used for any type of system in which a rocker-type switch mechanism is needed. For example, the present invention can be used on home and utility electronic products and systems, (e.g., stereos, CDs, VCRs, control systems, etc.), and in numerous other systems and applications. Manufacturing and molding costs can be reduced with the present invention and it eliminates a source of squeaking sounds often caused by existing rocker-type switches and switch mechanisms.

By controlling the pressures applied to the sides of the rocker-type switch member, and regulating the size and thickness of the support members or pads, control of the movement of the switch member can be regulated and optimized. In addition, the "feel" of the actuation can be regulated as desired. The switch member is also self-aligning and retained more precisely in the retainer or housing in order to prevent unnecessary movement. In addition, paints, lubrication materials and/or other coatings are necessary in the retainer or housing with the present invention. Paints, lubrication and other coatings are often used with prior art rocker-type switch members in order to attempt to prevent squeaking and facilitate ease of movement.

BRIEF DESCRIPTION OF THE DRAWINGS

The present invention will now be described, by way of example, with reference to the accompanying drawings, in which.

DESCRIPTION OF THE PREFERRED EMBODIMENT(S)

Figure 1:
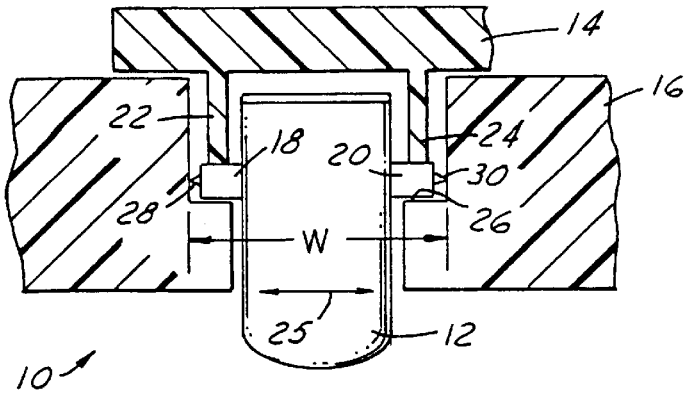
(PRIOR ART) FIG. 1
FIG. 1 illustrates a prior art rocker-type switch mechanism.
Figure 2:
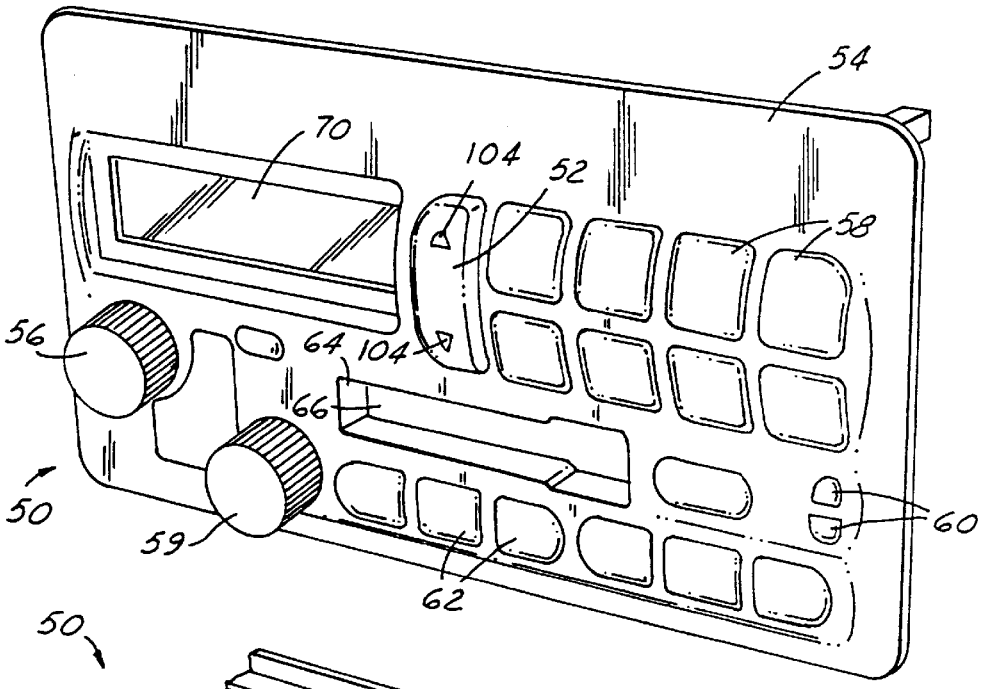
FIG. 2 is a perspective view of a vehicle audio system in which the present invention can be utilized.
Figure 3:
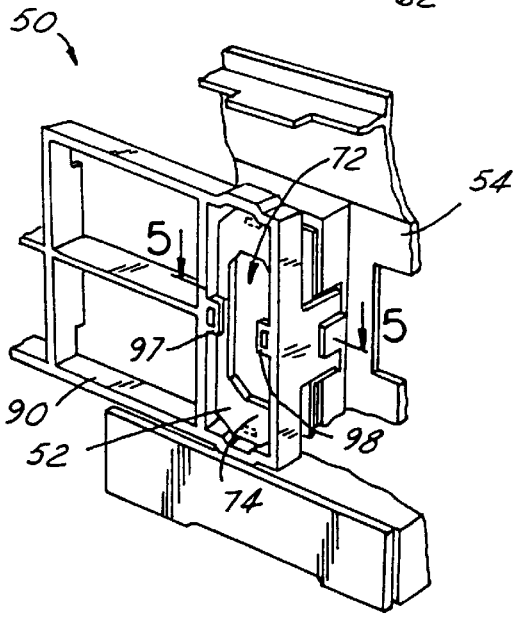
FIG. 3 is a rear view of a portion of the electronic audio system shown in FIG. 2.

A prior art switch-type mechanism for an electronic mechanism or system is shown in FIG. 1. The mechanism is designated in general by the reference numeral 10. The mechanism includes a rocker-type button member 12 positioned in a retainer member 14 which in turn is positioned in and attached to a trimplate member 16.

The switch member 12 has a pair of post members 18 and 20 which protrude from the sides thereof and allow the button-type switch member to rotate or pivot (a/k/a "rock") around them. The post members 18 and 20 are positioned and situated on support members 22 and 24, respectively, which are attached to the retainer member 14. The switch member 12 is positioned in a pocket or recess 26 in the trimplate member 16. Protruding or pointed ends or projections 28 and 30 are situated on the ends of the post members 18 and 20, respectively. The projections 28 and 30 are dimensioned to be in contact with the sides of the pocket 26 in order to hold the switch member 12 in place, prevent it from moving side-to-side, and allowing it to rotate or rock on the support members 22 and 24. ("Side-to-side" movement is indicated by the arrow 25.)

In order to prevent the button or switch member 12 from moving from side-to-side when installed in the trimplate pocket 26, the actual width of the switch member 12 at the ends of the projections 28 and 30 is made slightly greater than the width "W" of the pocket 26. Over time and usage, however, this interference causes the paint or other coating on the ends of the projections 28 and 30 and the sides of the trimplate pocket 26 to rub or wear off. This allows undesirable side-to-side movement of the switch member 12, and also often causes a squeaking sound to occur during use, particularly when similar materials are used for the components in contact. The switch member 12, trimplate member 16, and retainer member 14 are typically made from a plastic-type material, and thus have similar hardness and expansion/contraction characteristics. Although similar materials facilitate even expansion and contraction, they also facilitate frictional forces and chatter which occurs when two similar materials come into contact with each other.

The present invention is described herein in use in an electronic audio system, such as the audio mechanism 50 as shown in FIGS. 2–5. However, it is to be understood that such use is merely representative of the numerous electronic and other mechanisms in which the present invention can be utilized. The present invention can be used, for example, in automobiles and vehicles to activate or control numerous electronic systems (such as power seats, radios, heated seats, windshield wipers, emergency lights, turn signals, cruise control, drive systems, navigation systems, travel programs, etc.), in home and utility appliance applications (such as VCRs, radios, CD players, televisions, kitchen appliances, workshop tools, etc.) and in any other situation in which a rocker-type switch mechanism is desired.

Depending on the materials in which the switch mechanism and electronic mechanism are made, the present invention can still have many other uses. For example, in most of the applications mentioned above, the switch mechanism and electronic mechanism are typically made of a plastic or plastic-type material (polycarbonate, nylon, an acrylic, mixtures thereof, etc.). However, the rocker switch mechanism of the present invention could also be made of a metal material for high strength applications, or a ceramic material for high temperature applications. Also, the various components of the switch mechanism, as well as components of the adjacent electronic mechanism are typically made of the same or similar materials in order to have the same or substantially the same coefficient of thermal expansion.

In the electronic mechanism shown in FIGS. 2 to 5, the invention is particularly related to a rocker-type switch member 52 which is positioned in the trimplate or faceplate member 54 of an electronic audio mechanism 50. The audio mechanism 50 also has a number of other button members and switch members, such as on/off—volume switch member 56, a plurality of pre-set station buttons 58, station tuner 59, a clock setting mechanism 60, and a series of buttons or switch members 62 for use in activating a tape player. In this regard, as is typical with electronic-audio systems today, the mechanism 50 also has a slot 64 with a moveable door member 66 for insertion of an audio cassette, and a digital readout display 70, which indicates, for example, the station, time, and other pertinent information to the driver or user.

Preferably, the buttons and switches are backlit and have translucent portions thereon so that they can be better viewed at night and in other low light situations. Also, a circuitboard (not shown) is typically positioned on the rear of the trimplate member 54 and contains the various electronic components used to activate the cassette player, radio, and other electronic systems.

Figure 4:
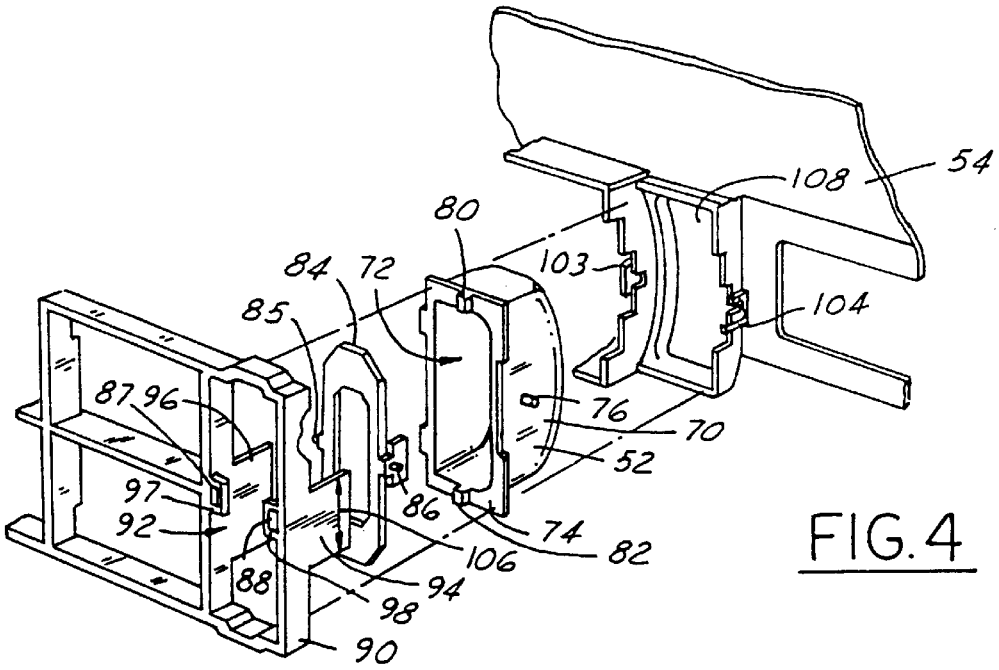
FIG. 4 is an exploded view of the portion of the audio system shown in FIG. 3, the exploded view illustrating the components of the switch mechanism in accordance with the present invention.

The switch member 52 has a generally rectangular shape as shown in FIG. 4 and is preferably molded from a plastic material, such as polycarbonate, nylon, an acrylic, or mixtures thereof. The member has a rounded exterior shell or surface 70, a hollow interior or cavity 72, an exterior retaining plate or flange 74, a pair of post members 76 and 78, and a pair of switch activation members 80 and 82.

The switch member 52 is positioned in a retainer member 90 which has a shaped frame or enclosure 92 designed for the dimensions of the switch member 52. The retainer member 90 has a pair of upstanding self-aligning support members 94 and 96 which are adapted to contact the sides of the switch member 52, as well as provide platforms on which the post members 76 and 78 of the switch member 52 rock or rotate. In this regard, when the switch member 52 rocks or rotates around the post members 76 and 78, the switch activation members 80 and 82 are adapted to contact biased contact members on the circuitboard (not shown) and activate or control one or more functions of the electronic audio system. The biased contact members and electronic circuitboards are well known to persons of ordinary skill in the art, and it is not necessary to explain them further in more detail herein.

In order to assure that the activation members 80, 82 accurately and correctly contact and activate the contact members on the circuitboard, a paddle member 84 is preferably provided. The paddle member is attached by pivot pins 85 and 86 in mating sockets 87 and 88, respectively, in retainer member 90. In this manner when the switch member 52 is rotated to actuate an electronic switch mechanism on the circuitboard, the particular switch activation member 80 or 82 makes contact with the corresponding end of the paddle member 84 which in turn rocks or rotates around the pivot pins 85 and 86 and actually makes contact with the circuitboard switch mechanism.

The flange or retaining member 74 is dimensioned such that when the electronic mechanism 50 is assembled, the switch member 52 is positioned between the trimplate member 54 and retainer member 90, and can not be removed from the front of the audio mechanisms. The support members 94 and 96 are also installed between flange members 103 and 104 on the trimplate member 54 in order to keep the support members in alignment and not expand or "bulge-out" when the audio mechanism 50 is assembled.

The support members 94 and 96 are provided with a sufficient width 106 in order to make contact with a significant portion of the outer surface of the sides of the switch member 52. This minimizes yawing or twisting of the switch member 52 in the retainer member 90 or trimplate member 54, automatically aligns the switch member 52 in the retainer and trimplate members and provides sufficient friction on the switch member to hold it in place, provide tactile feedback to the user, and not allow undesirable or unwanted "rocking" of the switch member when not being used by the operator. In order to increase the force of contact of the support members 94 and 96 with the sides of the switch member, the thickness 105 of the support members could be increased as desired.

Figure 6:
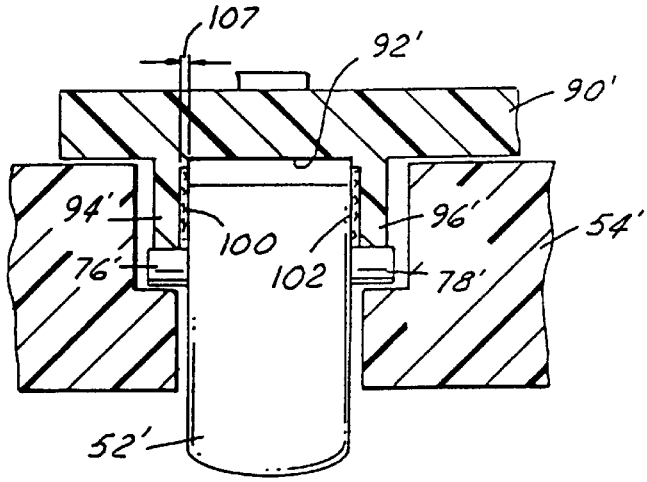
FIG. 6 illustrates an alternate embodiment of the invention.

It is also possible to provide one or more support pad members 100 and 102 on one or both of the support members 94' and 96', in order to make contact with the switch member 52' and provide a different "feel" and movement. This is shown in FIG. 6 where similar members are numbered with similar reference numbers followed by a "prime." The support pad members 100 and 102 could be made of a rubber, felt, or fiber-type material in order to cushion and change the frictional contact with the switch member. Also, the thickness 107 of the pad members could be adjusted as desired in order to adjust or change the "feel" of the actuation of the switch member 52'.

When the switch member 52 is positioned in the retainer member 90, the switch member 52 is positioned between the support members 94 and 96 (or between support pad members 100 and 102, if utilized). At the same time, the post members 76 and 78 are positioned on the ends of the support members 94 and 96, respectively, which allows the member 52 to "rock" or rotate end to end.

It is also possible to provide one or more raised or detent members on the support members 94 and 96, as well as mating detent or raised members, respectively, on the sides of the switch member 52 (not shown). The mating members will allow placement of the switch member 52 in one or more discrete positions in the retainer member and provide tactile feedback to the user of a change of position of the switch member.

When the switch member 52 is used, for example, as a radio "seek and scan" button member, letters or other indicia such as arrowheads 104 can be positioned on the front surface in a translucent material. In this manner, the switch member 52 can be backlit in any conventional manner which allows the wording or other symbols on the front surface of the switch member 52 to be viewed at night and in other low light situations. The switch member could also be made of a clear acrylic material with appropriate legends thereon. If individual lamps or point light sources are utilized, they can protrude from the circuitboard member directly into the cavity or recess 72.

Figure 5:
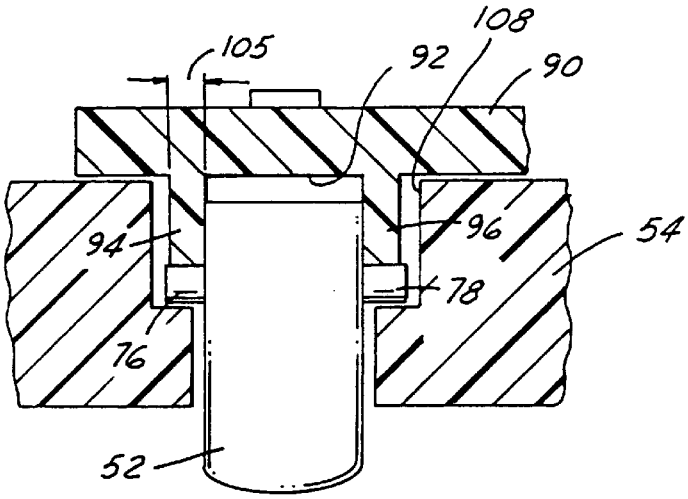
FIG. 5 is a cross-sectional view of the present invention, the cross-section being taken along lines 5—5 in FIG. 3 and in the direction of the arrows.

The support members 94 and 96, with or without the supporting pad members 100 and 102, are of a sufficient thickness in order to securely position the switch member 52 between them, and thus in the retainer member 90 (See FIG. 5). This prevents side-to-side movement of the switch member 52 in the retainer member and thus in the trimplate and audio mechanism 50.

As indicated above, the thickness of the support and pad members and thus the width of the distance between them, can be adjusted in order to control the pressure by which the switch member 52 is held in place. The width of the support pads—and thus the extent to which the support pads are in contact with the sides of the switch member 52—can also be changed or adjusted for the same purpose. Similarly, the material used for the support pads and the texture of the outer surface can be modified as desired. The "feel" of the movement or actuation of the switch member 52 can thus be controlled from an easy activation level, to a relatively stiff or firmer activation level.

As shown in FIG. 5, the post members 76 and 78 preferably are not in contact with the sides of the recess or pocket 108 in the trimplate member 54. Thus, there is no source for squeaking of the switch member 52 relative to the trimplate member. With the present invention, it is also not necessary to lubricate the trimplate pockets with a lubrication solution or coating, such as grease, paint, or similar materials.

The use of the wider support members 94 and 96 also provides for better alignment of the switch member 52. In this regard, once the switch member 52 is positioned between the support members, the switch member 52 is essentially self-aligning.

While particular embodiments of the invention have been shown and described, numerous variations and alternate embodiments will occur to those skilled in the art. Accordingly, it is intended that the invention be limited only in terms of the appended claims.

I claim:

1. A switch mechanism comprising:

a retainer member and a rocker-type switch member, said retainer having a pair of extending support members, each of said support members having a support pad member thereon, said switch member having a pair of post members positioned on said extending support members, said switch member positioned in said retainer member between said support pad member, said retainer member and said switch member being made of the same materials, wherein said switch member is self-aligning in said retainer member and the movement of said switch member relative to said retainer member can be adjusted by means of said support pad members.

2. The switch mechanism as set forth in claim 1 further comprising a trimplate member, having a pocket and an opening therein, said retainer member positioned on said trimplate member, and said switch member positioned in said pocket in said trimplate member and protruding through said opening in said trimplate member.

3. The switch mechanism as set forth in claim 2 wherein said pair of post members on said switch member are spaced from contact with said pocket in said trimplate member.

4. The switch mechanism as set forth in claim 1 wherein said support pad members on said extending support members have a size and thickness to control the movement of said switch member.

5. The switch mechanism as set forth in claim 1 wherein said support pad members align said switch member in said retainer member to minimize side-to-side movement of said switch member.

6. The switch mechanism as set forth in claim 1 wherein said retainer member and said switch member are both made of a material taken from the group comprising plastic, polycarbonate, acrylic, nylon, metal and ceramic.

7. A method for assembling a switch member in a switch mechanism, said switch mechanism having a retainer member with a pocket and pair of extending support members, and said switch member having a pair of protruding post members, said method comprising the steps of:

positioning a support pad member on each of said extending support members, positioning said switch member in said pocket of said retainer member such that said switch member is positioned between said support pad members and said protruding post members are positioned on said extending support member, and positioning a paddle member in said retainer member.

8. The method as set forth in claim 7 further comprising the step of adjusting the thickness of the support pad member in order to control the ease of movement of the switch member in said retainer member.

9. The method as set forth in claim 7 further comprising the step of adjusting the size of the support pad member in order to control the ease of movement of the switch member in said retainer member.

10. The method as set forth in claim 7 further including the step of positioning said retainer member in a trimplate member, said trimplate member having a pocket therein for positioning of said switch member.

11. An electronic mechanism having a switch mechanism therein, said switch mechanism having a retainer member, a switch member positioned in said retainer member, and a paddle member positioned in said retainer member, said switch member having a pair of side surfaces and a pair of pivot post members, said retainer member having a pair of upstanding support members, said support members having surfaces thereon making surface-to-surface contact with said pair of side surfaces of said switch member.

12. The electronic mechanism as set forth in claim 11 further comprising a trimplate member on said electronic mechanism, said trimplate member having a pocket therein, said switch member being positioned in said pocket without any contact therewith.

13. The electronic mechanism as set forth in claim 11 further comprising at least one pad member positioned on at least one of said pair of upstanding support members.

14. The electronic mechanism as set forth in claim 13 wherein a pad member is positioned on each of said pair of upstanding support members.

15. The electronic mechanism as set forth in claim 11 wherein said retainer member and said switch member are both made of a material taken from the group comprising plastic, polycarbonate, acrylic, nylon, metal and ceramic.

* * * * *